United States Patent [19]

Toropov et al.

[11] 4,426,870

[45] Jan. 24, 1984

[54] METHOD AND TOOL FOR MAKING ELASTIC THREAD HAVING CLOSED HELICAL CAVITY INSIDE THREAD PROFILE

[75] Inventors: Gennady A. Toropov; Stepan P. Shamenko, both of Dnepropetrovsk; Georgy L. Tsvirko, Tula; Viktor G. Oleinichenko, Dnepropetrovsk; Georgy A. Khitun; Anatoly I. Menyailenko, both of Taganrog, all of U.S.S.R.

[73] Assignee: Dnepropetrovsky Gorny Institut Imeni Artema, Dnepropetrovsk, U.S.S.R.

[21] Appl. No.: 247,296

[22] PCT Filed: Jun. 30, 1980

[86] PCT No.: PCT/SU80/00118

§ 371 Date: Mar. 30, 1981

§ 102(e) Date: Mar. 30, 1981

[87] PCT Pub. No.: WO81/00365

PCT Pub. Date: Feb. 19, 1981

[30] Foreign Application Priority Data

Jul. 31, 1979 [SU] U.S.S.R. ..... 2804079

[51] Int. Cl.[3] ..... B21H 3/08

[52] U.S. Cl. ..... 72/118; 72/103; 72/123

[58] Field of Search ..... 72/98, 103, 104, 118, 72/119, 123, 126; 10/1 R, 1 B, 10 R; 411/108, 109, 110, 111, 411, 417

[56] References Cited

U.S. PATENT DOCUMENTS

| | | | |
|---|---|---|---|
| 793,824 | 7/1905 | Culliney | 411/309 |
| 2,349,863 | 5/1944 | Hallberg | 72/126 |
| 3,258,797 | 7/1966 | Budd | 10/152 T |
| 3,813,718 | 6/1974 | Kamiya | 411/411 |
| 3,872,700 | 3/1975 | Matej | 72/469 |

FOREIGN PATENT DOCUMENTS

| | | | |
|---|---|---|---|
| 1435107 | 3/1966 | France | 72/103 |

*Primary Examiner*—Lowell A. Larson

*Attorney, Agent, or Firm*—Fleit, Jacobson, Cohn & Price

[57] ABSTRACT

A method of making an elastic thread having a closed cavity inside the thread profile comprises plastically deforming the walls of a preformed helical groove by means of a thread-forming tool (2). The helical groove is made at least double-start and having a pitch equal to that of the thread to be formed, one of the starts serving for directing the thread-forming tool (2) which, during the process of plastically deforming the walls of the helical groove, transforms each of the remaining starts into a closed helical cavity (3) disposed inside the thread profile.

A thread-forming tool for practicing the above described method comprises threading rollers (7) having a circular thread and uniformly disposed around a circumference in a body (4) provided with a starting portion (5). Groove-forming rollers (6) are uniformly disposed around a circumference at the side of the starting portion (5) of the body (4) and in front of the threading rollers (7), said groove-forming rollers being provided with a circular thread having a pitch equal to P/n, where P is a pitch of the thread to be rolled, and $n \geqq 2$ is a number of the starts of the helical groove.

2 Claims, 4 Drawing Figures

METHOD AND TOOL FOR MAKING ELASTIC THREAD HAVING CLOSED HELICAL CAVITY INSIDE THREAD PROFILE

TECHNICAL FIELD

The invention relates to the art of mechanical working, and more particularly to methods and tools for making elastic threads having a closed helical cavity inside the thread profile by plastic deformation of the metal being in cold state.

BACKGROUND ART

Methods of making threads by plastic deformation of the blank metal, and by rolling in particular, which are now widely applied (see, for example, Pisarevsky M.I., Nakatyvanie tochnykh rezb i shlitsev, 1968, Mashgiz, Moscow-Leningrad), together with such obvious advantages as high capacity, metal saving, and high strength of resulting threads, are also characterized by substantial shortcomings. Among these are first of all a strict tolerance for the blank size intended to prevent jamming the tool when making threads inside bores, and substantial thread-forming forces affecting the tool, especially when making threads inside bores of small diameters.

Known in the art is a method of making an elastic thread having a closed helical cavity inside the thread profile, disclosed in Japan Pat. No. 48-20977, published June 25, 1973, Minoru Kamiya.

The above method comprises preforming a helical groove on the blank and subsequent plastic deformation of its walls by means of a thread-forming tool. The thread-forming tool is positioned to match the top portions of its profile with the top portions of the helical groove. Next, the thread-forming tool is deepended into the top portions of the helical groove lower than the profile thereof, thus providing deformation of its walls which results in obtaining a thread having a closed helical cavity inside the thread profile.

Due to the presence of a closed helical cavity inside the thread profile, the thread thus obtained allows the tolerance for the blank size to be reduced, thread-forming forces affecting the tool to be cut down, and jamming the tool in the process of rolling a female thread to be excluded.

However, the tests have demonstrated the impossibility of obtaining stable elasticity of the thread when making threads in accordance with the above method which is due to the displacement of the cavity relative to the thread profile.

Moreover, when deepening the tool into the top portions of the helical groove, the thread-forming forces affecting the tool are still substantial due to the mode of the metal flow. The metal is extruded in the direction of the thread-forming tool in a plane normal to the axis of the workpiece, thereby filling the profile of the tool.

Known in the art is a thread-rolling tool (U.S. Pat. No. 3,069,940) comprising threading rollers uniformly disposed around the periphery in a body provided with a starting portion. The roller axes are in an angular position relative to the generating line of the body, which angle is equal to the angle of spiral of the resulting thread.

To obtain the above described elastic thread by means of such a tool and by plastic deformation of the walls of the preformed helical groove, it is necessary to position said tool to match the top portions of the profile thereof with the top portions of the profile of the above helical groove. Such positioning may be provided, for example, by means of an MDTW gearing system comprising a machine-tool, a device, a tool, and a workpiece, by adjusting the same to obtain a rigid engagement between the tool and the workpiece. However, such an arrangement substantially complicates practicing the method. Moreover, when using the available MDTW systems, it is rather difficult to ensure a sufficiently rigid engagement between the tool and the workpiece which results in that the cavity inside the profile of the thread to be produced is displaced relative to the axis thereof, and the elasticity parameters of the thread are not stable.

DISCLOSURE OF INVENTION

The invention is based on the problem of providing a method of making an elastic thread having a closed cavity inside the thread profile, and a thread-forming tool for practicing the same, providing for stability of the elasticity properties of the thread and decreasing thread-forming forces.

The problem set forth is solved by the provision of a method of making an elastic thread having a closed cavity inside the thread profile by plastic deformation of the walls of a preformed helical groove by means of a thread-forming tool, wherein, according to the invention, said helical groove is made at least double-start and having a pitch equal to the lead of the thread being formed, one of starts serving for directing the thread-forming tool which transforms each of the remaining starts into a cavity disposed inside the thread profile, in the process of deformation of the helical groove.

Such an arrangement makes it possible to increase the stability of the elasticity properties of the thread due to the fact that in this case the cavity is symmetric relative to the axis of the thread profile.

Moreover, when applying said method for thread deformation, the mode of the metal flow along the thread profile is changed, and experimental tests of the stressed and deformed metal state in the area of the thread profile have demonstrated that the process of making the thread proceeds at lower deformations and stresses in the metal, and consequently, at lower thread-forming forces.

The problem set forth is solved also by the provision of a thread-forming tool for practicing the above method, comprising threading rollers having a circular thread and uniformly disposed around the periphery in a body provided with a starting portion, wherein, according to the invention, groove-forming rollers are uniformly disposed around the circumference at the side of the starting portion of the body and in front of the threading rollers, said groove-forming rollers being provided with a circular thread having a pitch equal to P/n, where P is a pitch of the thread to be rolled, and $n \geqq 2$ is the number of the starts of the helical groove.

The above tool makes it possible to increase stability of the elasticity properties of the thread because, according to the above described method, during its motion along one of the starts of the helical groove, said tool transforms the remaining start/starts into the helical cavity/cavities being strictly symmetric relative to the axis of the thread profile. It is obvious that in this case thread-forming forces will be insignificant.

BRIEF DESCRIPTION OF DRAWINGS

The invention is further explained in terms of specific embodiments thereof with reference to the accompanying drawings, in which.

BEST MODE FOR CARRYING OUT THE INVENTION

Making a thread in accordance with the specified method is carried out as follows. At least double-start helical groove having a pitch equal to that of the resulting thread, is preformed on the blank by any of the methods known in the art. Following this, the walls of the groove thus prepared are deformed by means of the thread-forming tool which during its motion along one of the spaced starts transforms each of the remaining starts into a cavity disposed inside the thread profile.

Figure 1:
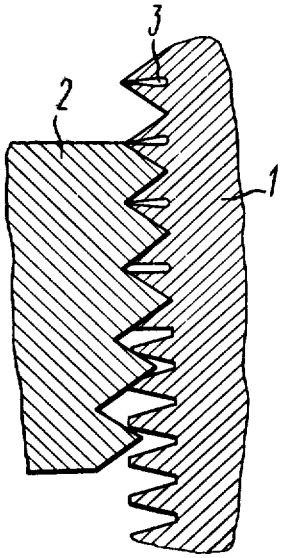
FIG. 1 is a schematically illustrated process of plastic deformation of the walls of the preformed double-start helical groove, according to the invention.

An example of practicing the above method when making a female resilient thread M18x1.5-6H is shown in FIG. 1.

A double-start helical groove having a pitch of 1.5 mm was prerolled inside the bore of a workpiece 1 constructed from the steel 20, using a tap for chipless rolling threads. Next, a tap 2 M18x1.5 intended for chipless rolling threads inside blind bores in accordance with the USSR State Standard 18840-13, was screwed into the bore. One of the starts served for directing the tap, while the other start was out of contact with the tool, and formed a cavity 3 in the process of deformation of the groove walls, said cavity being symmetric relative to the axis of the profile of the finished thread.

Figure 2:
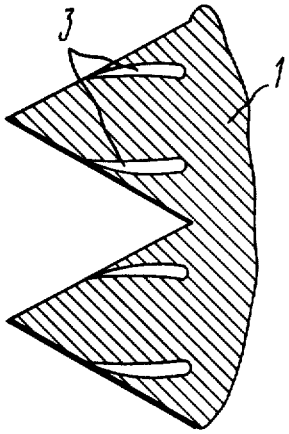
FIG. 2 is a fragmentary view of the thread profile obtained by deforming the walls of a triple helical groove.

It is to be clearly understood that if the helical groove is provided with more than two starts, the process of making a thread will be carried out in a similar way; in the case when the helical groove is made triple, two cavities being symmetrically disposed relative to the axis of the thread profile are formed therewithin in the process of deformation of the groove walls (FIG. 2), and if the above groove is made quadruple, three cavities are formed etc.

Symmetric position of the cavity/cavities inside the thread profile ensures stability of the elasticity properties of the resulting thread.

Moreover, the experimental tests of the stressed and deformed metal state in the area of the thread profile have demonstrated that the process of making a thread proceeds at lower deformations and stresses in the metal, and consequently, at lower thread-forming forces. This factor is caused by a more advantageous mode of the metal flow along the thread profile.

The provision of more than two starts in the helical groove makes it possible to improve the elasticity of the thread profile, thereby lowering the requirements to a tolerance for the blank size and further decreasing the influence of the thread-forming forces on the tool, thus creating the most advantageous conditions when making a thread inside the bores of a small diameter (less than 8 mm). Besides, the elasticity of the thread profile being high, the load is distributed in a more uniform manner between the thread helices in the conjugation of threads.

Making a resilient thread by means of two tools as shown in a specific example of practicing the above method, results in complicating and lengthening the above process.

Figure 3:
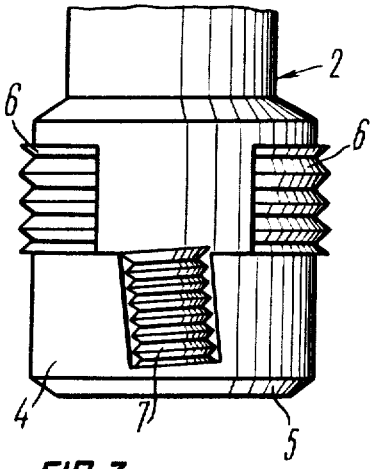
FIG. 3 is a schematic front view of the thread-rolling tool of the invention.
Figure 4:
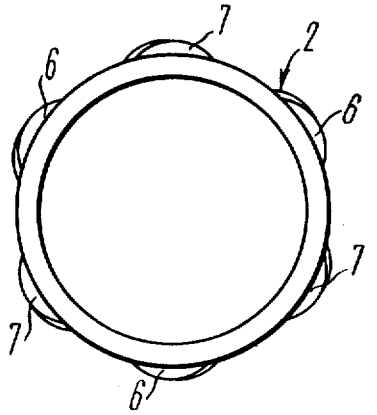
FIG. 4 is the same as in FIG. 3 viewed from the side of the starting portion.

The above process is preferably carried out by means of a thread-rolling tool developed by the authors of the present invention and shown in FIGS. 3 and 4. Said tool comprises a body 4 provided with a starting portion 5, groove-forming rollers 6 and threading rollers 7 being uniformly disposed around the circumference in the body 4.

The groove-forming rollers 6 are disposed within the body 4 in front of the threading rollers 7 at the side of its starting portion 5, and are provided with a circular thread having a pitch of P/n, where P is a pitch of the thread to be rolled, and $n \geqq 2$ is the number of the starts of the helical groove. In the present disclosure there is considered a tool whose groove-forming rollers 6 form a double-start groove, i.e. $n=2$.

The threading rollers 7 are provided with a circular thread having a pitch equal to that of the thread to be rolled.

The axes of the groove-forming rollers 6 and those of the threading rollers 7 are in an angular position relative to the generating line of the body 4 being in the given example a cylinder, at an angle equal to the angle of the helix.

Making a thread by means of the proposed tool is carried out as follows. The groove-forming rollers 6 during their motion within the bore of the workpiece in a self-engaging manner are pre-rolling a double-start helical groove having a pitch equal to that of the circular thread of the rollers 7. The formation of the double-start helical groove can be explained by the fact that the pitch of the profile of the helical groove is made two times smaller when the helical groove is formed, the threading rollers 7 start operating.

One of the starts of the helical groove is used for directing the threading rollers 7 which follow the groove-forming rollers 6 which threading rollers when deforming the walls of the helical groove, transform the second start into a cavity being in a symmetric position relative to the axis of the thread profile.

It is obvious that the process of making an elastic thread by means of the above tool gets simplified and shortened.

It is further obvious that such a principle of making a thread involving a preformed groove can be utilized not only for making female threads, but for male threads as well.

INDUSTRIAL APPLICABILITY

The present invention is the most expedient for applying when making an elastic thread inside the bores of a small diameter (less than 8 mm), and inside blind bores.

We claim:

1. A method of making an elastic thread having a closed cavity inside the thread profile by plastically deforming the walls of a performed helical groove by means of a thread-forming tool, said method comprising forming a helical groove to define a symmetrical thread profile having at least a double-start and having a pitch equal to that of the thread being formed, one of said starts serving for directing the thread-forming tool, and plastically deforming the walls of the helical groove into a closed helical thread having a cavity disposed inside the thread profile by moving a thread forming tool along said groove so that spaced starts are transformed into a cavity.

2. A thread-forming tool for making an elastic thread having a closed cavity inside the thread profile, said tool comprising threaded rollers having a circular thread and uniformly disposed around a circumference in a body provided with a starting portion, including groove-forming rollers uniformly disposed around a circumference at the side of the starting portion of the body and in front of the threading rollers, said groove-forming rollers being provided with a circular thread having a pitch equal to P/n, where P is the pitch of the thread to be rolled, and $n \geqq 2$ is the number of the starts of the helical groove, said threading rollers positioned to follow said groove-forming rollers so that spaced starts are transformed into a cavity.

* * * * *